US005221801A

United States Patent [19]

Bruti et al.

[11] Patent Number: 5,221,801

[45] Date of Patent: Jun. 22, 1993

[54] AUTOMATIC ACCOMPANIMENT MUSICAL APPARATUS HAVING PROGRAMMABLE GRADUAL TEMPO VARIATION DEVICE

[75] Inventors: Luigi Bruti, Pedaso Ascoli Piceno; Demetrio Cuccu', Fermo Ascoli Piceno, both of Italy

[73] Assignee: Roland Europe S.p.A., Teramo, Italy

[21] Appl. No.: 710,003

[22] Filed: Jun. 4, 1991

[30] Foreign Application Priority Data

Nov. 21, 1990 [IT] Italy ..... 22138 A/90

[51] Int. Cl.[5] ..... G10H 1/40

[52] U.S. Cl. ..... 84/612; 84/636; 84/652; 84/668; 84/DIG. 12

[58] Field of Search ..... 84/DIG. 12, 636, 668, 84/714, 612, 652

[56] References Cited

U.S. PATENT DOCUMENTS 4,095,501 6/1978 Aoki ..... 84/636
4,361,066 11/1982 Jones ..... 84/DIG. 12 X
4,432,266 2/1984 Nakada ..... 84/DIG. 12 X
4,542,675 9/1985 Hall, Jr. et al. ..... 84/DIG. 12 X
4,733,593 3/1988 Rothbart ..... 84/484
4,887,505 12/1989 Suzuki ..... 84/714
4,969,384 11/1990 Kawasaki et al. ..... 84/612
4,993,306 2/1991 Ueta et al. ..... 84/601

*Primary Examiner*—William M. Shoop, Jr.
*Assistant Examiner*—Brian Sircus
*Attorney, Agent, or Firm*—Keck, Mahin & Cate

[57] ABSTRACT

An automatic accompaniment playing device comprising a memory for storing various normal rhythm patterns, switching devices for selecting any one of said normal rhythm patterns from said memory to play the same at a predetermined tempo, a settable control unit for generating a first information regarding the magnitude of tempo variation of said predetermined tempo and for generating a second variation; the device furthermore comprises control registers for gradually changing the tempo of said rhythm patterns based upon said first and second informations provided by said control unit.

15 Claims, 7 Drawing Sheets

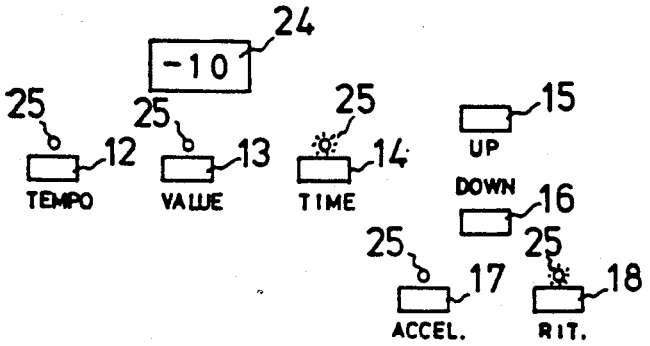
FIG. 4
| REG.DTP | REG.STP | REG.MC | REG.TM | REG.TH | REG.TT |
|---|---|---|---|---|---|
| 120 | 120 | 920 | 10 | -40 | -4 |
| REG.FC |
|---|
| 0 |
FIG. 5
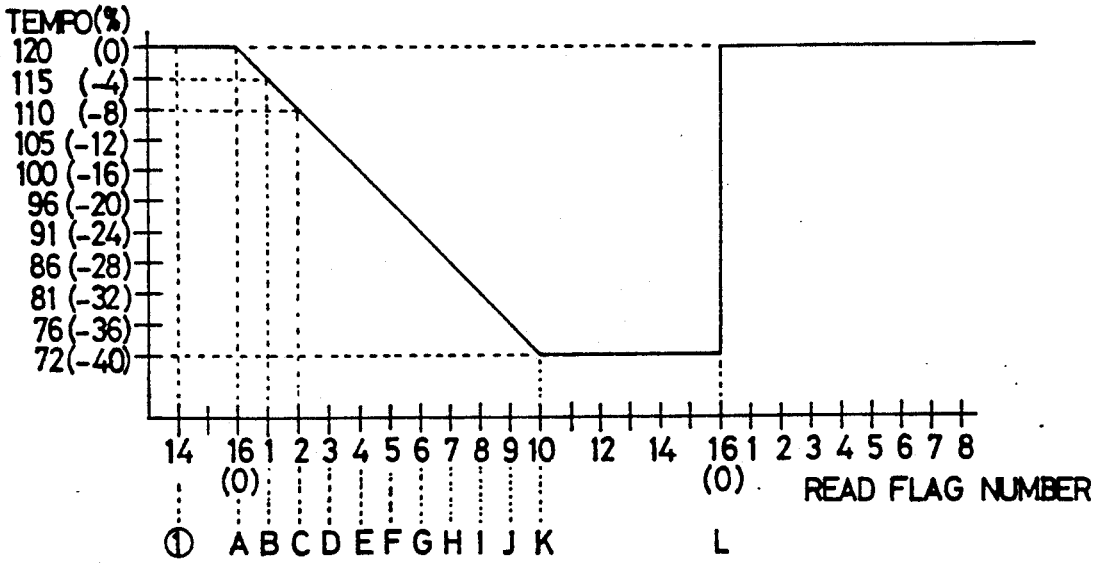
FIG. 6

| ATH | ATM | ATT | |
|---|---|---|---|
| 30 | 10 | 3 | |
| RTH | RTM | RTT | |
| -40 | 10 | -4 | |
| DTP | TM | TT | TTP |
| 120 | 10 | -4 | 1.2 |
| STP | AF | FC | MC |
| 120 | 0 | 0 | 920 |

| ATH | ATM | ATT | |
|---|---|---|---|
| 30 | 10 | 3 | |
| RTM | RTM | RTT | |
| -40 | 10 | -4 | |
| DTP | TM | TT | TTP |
| 120 | 10 | 3 | 1.2 |
| STP | AF | FC | MC |
| 72 | 1 | 0 | 1112 |

AUTOMATIC ACCOMPANIMENT MUSICAL APPARATUS HAVING PROGRAMMABLE GRADUAL TEMPO VARIATION DEVICE

BACKGROUND OF INVENTION

This invention relates to an automatic accompaniment playing device and, especially, to such device which can change the tempo of rhythm accompaniment in the middle of its performance.

An example of such automatic accompaniment playing device is disclosed in the Japanese patent opening gazette No. S57-100487. When a "ritardando" switch is actuated in this device while a rhythm accompaniment is played, the tempo of the accompaniment is gradually reduced or retarded and, when the tempo drops below a predetermined level, the accompaniment is automatically suspended. Another example of similar automatic accompaniment playing device is disclosed in the Japanese utility model opening gazette No. H2-85496. In this device, variation patterns such as fill-in pattern and ending pattern are stored in addition to normal patterns and, when the variation patterns are selectively accessed by pattern selection switches and a "ritardando" switch is then pushed while a normal rhythm pattern is played, the accompaniment is played in a rhythm of a selected variation pattern upon completion of the normal pattern and, at the same time, a ritardando effect is applied to the tempo of its rhythm and, upon completion of the variation pattern, the normal rhythm of the original tempo is recovered. The improved device disclosed in the Japanese utility model opening gazette No. H2-85497 is arranged to enable arbitrary insertion of a rhythm of a variation pattern provided with a ritardando effect in the middle of a normal rhythm accompaniment.

However, these prior art devices have such a disadvantage in that their ritardando patterns are fixed and the width of variation and time rate of variation of the tempo cannot be changed arbitrarily.

SUMMARY OF INVENTION

Accordingly, an object of this invention is to provide an improved automatic accompaniment playing device which can not only apply a ritardando effect to the tempo of a rhythm accompaniment in the middle of its performance, but also optionally select the width of variation and the time rate of variation of the tempo to realize more creative musical performance.

This object can be attained by this invention which provides an automatic accompaniment playing device comprising means for storing various normal rhythm patterns, means for selecting any one of said rhythm patterns to play the same at a predetermined tempo, means for generating a first information regarding the magnitude of tempo variation, means for generating a second information regarding the time for tempo variation, and control means for changing the tempo of said rhythm based upon said first and second informations.

These and other objects and features of this invention will be described in more detail below with reference to the accompanying drawings in conjunction with a preferred embodiment thereof.

BRIEF DESCRIPTION OF DRAWINGS

In the drawings:

FIG. 4 is a view similar to FIG. 3 wherein the width of tempo variation is set as 10%;

FIG. 5 is a view showing an initial state of registers in the control unit of a first embodiment of the device of FIG. 1;

FIG. 6 is a diagram showing a tempo variation in the first embodiment when a fill-in pattern is inserted;

DESCRIPTION OF PREFERRED EMBODIMENTS

Figure 1:
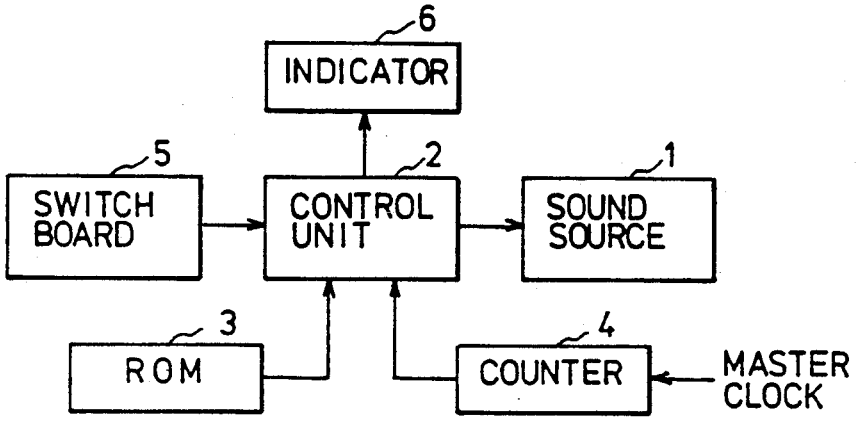
FIG. 1 is a block diagram showing a schematic configuration of the automatic accompaniment playing device according to this invention.

Referring to FIG. 1 showing a first embodiment, the device includes a sound source unit 1 of a known type including a waveform read-only memory (ROM) (not shown) for storing digital waveforms of various timbres and a digital-to-analog (D/A) convertor (not shown) for converting the digital waveform informations read out from the waveform ROM into analog waveform informations, and a control unit 2 for producing a command specifying one of the digital waveform informations to read out from the waveform ROM.

The control unit 2 includes a central processing unit (CPU) (not shown) for executing a program stored in a ROM 3 and a random-access memory (RAM) (not shown) used as a working memory such as a register or buffer required for executing the program. The program stored in the ROM 3 will be described in detail later.

In addition to this program, the ROM 3 stores various rhythm playing pattern informations corresponding to various rhythm patterns bar by bar, as shown below in Table 1. These rhythm patterns include originals such as rock, jazz, waltz and swing (e.g., ROCK—10, ROCK—20, . . . in Table 1) and variations thereof (e.g., ROCK—1 V, ROCK—2 V, . . . in Table 1), introduction patterns which may be inserted as ouvertures of these rhythms, ending patterns which may be inserted at the end of these rhythms, and fill-in pattern which may be inserted in the middle of performance of some rhythm patterns.

TABLE 1

| | SOUND SOURCE | HH | BD | SD | HT | MT | LT | RS | CS |
|---|---|---|---|---|---|---|---|---|---|
| ROCK-10 | 00000001 | 1 | 1 | 0 | 0 | 0 | 0 | 0 | 0 |
| | 00000010 | 0 | 0 | 0 | 0 | 0 | 0 | 0 | 0 |
| ROCK-1V | 00000011 | 1 | 0 | 0 | 0 | 0 | 0 | 0 | 0 |
| ROCK-20 | 00000100 | 0 | 0 | 0 | 0 | 0 | 0 | 0 | 0 |
| | 00000101 | 1 | 0 | 0 | 0 | 0 | 0 | 0 | 0 |
| ROCK-2V | 00000110 | 0 | 0 | 0 | 0 | 0 | 0 | 0 | 0 |
| : | 00000111 | 1 | 0 | 1 | 0 | 0 | 0 | 0 | 0 |
| : | | | | | | | | | |
| : | : | | | | | | | | |
| : | : | | | | | | | | |
| ENDING | 00001110 | 0 | 0 | 0 | 0 | 0 | 0 | 0 | 0 |
| | 00001111 | 1 | 0 | 0 | 0 | 0 | 0 | 0 | 0 |
| FILL-IN | 00010000 | 0 | 0 | 0 | 0 | 0 | 0 | 0 | 0 |

As shown in magnification in the right side of Table 1 for ROCK—10 as an example, each of these rhythm pattern playing informations has plurality of bits respectively corresponding to the timbres stored in the sound source unit 1, for example, hi-hat (HH), bass drum (BD), snare drum (SD), high tom (HT), mid tom (MT), low tom (LT), ride cymbal (RS) and clash cymbal (CS), and these bits are expressed as "1" corresponding to actuation or "0" corresponding to non-actuation and stored sequentially, for example, in sixteen addresses from 00000001 to 00010000 in accordance with variation of the time of rhythm. Each address corresponds to a sixteenth note and the addresses from 00000001 to 00010000 constitute a bar. Accordingly, for example, the address 00000001 in which the bits corresponding to hi-hat (HH) and bass drum (BD) are "1" indicates that the corresponding timbre sources are actuated and the address 00000010 in which all bits are "0" indicates that no timbre source is actuated. When one of the rhythm patterns is selected by the control unit 2, its rhythm playing pattern informations are sequentially read out and supplied to the sound source unit 1 by the control unit 2, thereby producing a predetermined rhythm from the sound source unit 1. It is possible to changing a read-out timing from the respective addresses at this time.

The read-out timing is given by generating a pattern read flag by counting a predetermined number of clock pulses from a master clock (not shown) by a counter 4 of FIG. 1. The read flag corresponds to a sixteenth note and occurs sixteen times in each bar of the abovementioned rhythm. The time interval of occurrence of the read flag varies with the predetermined number of counts corresponding to the tempo. The relationship of this number and the tempo, which is shown in Table 2 as an example, is also stored in the ROM 3 as a counter table. In Table 2, the value of tempo is expressed as the number of beats per minute and values from 50 to 300 are prepared as the values of tempo in the counter table. Accordingly, producible tempos are 50 to 300.

TABLE 2

| | | | | | | |
|---|---|---|---|---|---|---|
| TEMPO | 50 | 51 | 52 . . . 119 | 120 | 120 . . . 299 | 300 |
| COUNT | 1200 | 1196 | 1192 . . . 924 | 920 | 916 . . . 204 | 200 |

Figure 2:
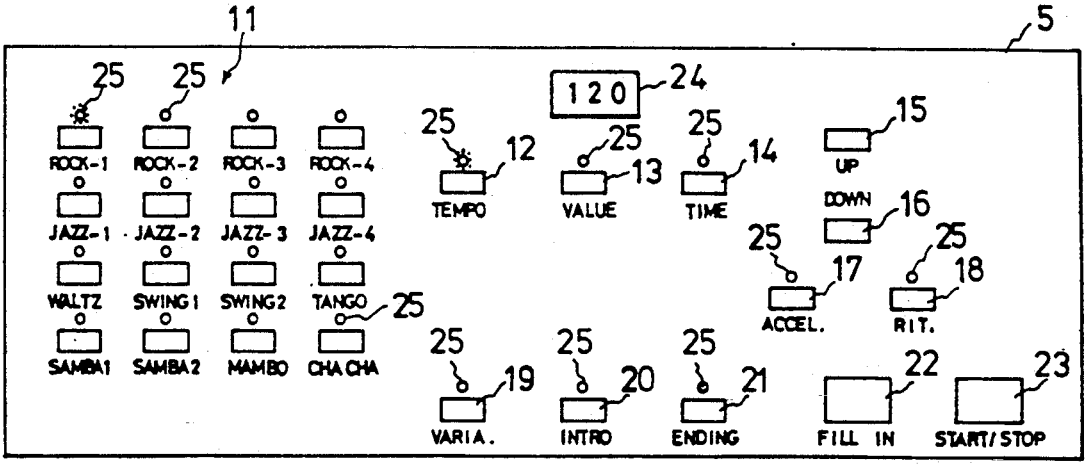
FIG. 2 is a front view showing a switch board of the device of FIG. 1.

The tempo setting and rhythm pattern selecting operations in the control unit 2 is effected through a switch board 5 of FIG. 1 and an indicator 6 is provided for visually indicating actuated switches and preset informations. FIG. 2 shows an example of the switch board 5 including indication means corresponding to the indicator 6.

In FIG. 2, the switch board 5 includes sixteen rhythm pattern selection switches 11, a tempo parameter selection switch 12, a value parameter selection switch 13, a time parameter selection switch 14, parameter up and down switches 15 and 16, an accelerando selection switch 17, a ritardando selection switch 18, a variation selection switch 19, an introduction selection switch 20, an ending selection switch 21, a fill-in insertion switch 22 and a start/stop switch 23, whose functions will be described later. Each of these switches excepting the switches 15, 16, 22 and 23 is provided at its upside with a light emitting diode (LED) 25 which is adapted to shine when it is actuated. The switch board 5 also includes a liquid crystal display 24 adapted to display an information such as tempo which is set by the abovementioned switches. The liquid crystal display 24 and the LEDs 25 are the indicating means of the indicator 6 FIG. 1.

When a rhythm is played in normal fashion, one of the rhythm pattern selection switches 11 corresponding to a desired rhythm is actuated and the tempo parameter selection switch 12 is actuated. Then, a value of current tempo is displayed by the liquid crystal display 24. Viewing the display, the parameter up or down switch 15 or 16 is actuated to bring the displayed value to a desired value. If the start/stop switch 23 is actuated when the desired value is displayed in the display 24, a selected rhythm pattern is played at the selected tempo. If the variation switch 9 is actuated in the middle thereof, the rhythm is substituted with its variation. In other words, the selected normal rhythm pattern ROCK—10, for example, is changed to its variation ROCK—1 V. When it is desired to play an introduction pattern before playing a rhythm, or play an ending pattern after playing the rhythm, the introduction or ending selection switch 20 or 21 may be actuated before the start/stop switch 23 is actuated. When it is desired to play a fill-in pattern in the middle of rhythm performance, the fill-in insertion switch 22 may be actuated as occasion demands. Such operations of the switches have no direct connection to the subject matter of this invention and, therefore, will not be described further.

As described in the preface, the subject matter of this invention is to change the time rate of tempo variation in the middle of rhythm performance. Now, the description will be made on this matter.

Figure 3:
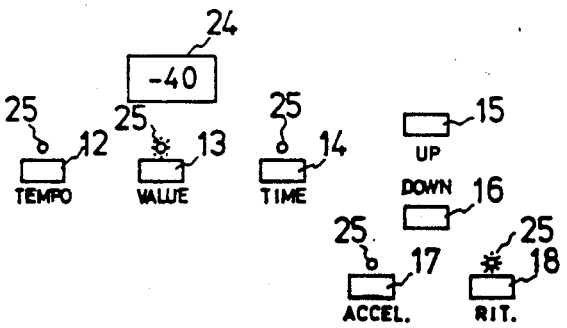
FIG. 3 is a view showing part of the switch board of FIG. 2 wherein the width of tempo variation is set as −40%.

In this invention, the rhythm pattern is selected first and then the original tempo is set in the same fashion as described above. In FIG. 2, two shining LEDs 25 and the display 24 show that the rhythm pattern of ROCK—1 of the tempo of 120 has been selected as an example. In the next step, the width of tempo variation is set. In this embodiment, this width is defined as a percent change of the final tempo with respect to the original tempo and the maximum width which can be set is ±100% of the original tempo. When it is desired to gradually raise the tempo, the accelerando selection switch 17 is pushed and then the value parameter selection switch 13 is pushed to display the abovementioned width value in the display 24. Then, the parameter up or down switch 15 or 16 is pushed to change this value into a desired value. Thus, the desired width of tempo variation is set in the control unit 2. When it is desired t gradually reduce the tempo, the ritardando selection switch 18 is pushed and then a similar operation is effected to set a desired width of variation. In FIG. 3, the display 24 and two shining LEDs 25 show, as an example, that the tempo is to be reduced to 40% of the original value.

Next, the aforementioned time rate of tempo variation is set in correspondence to the width of tempo variation. In this embodiment, this time rate of variation is defined as the time spent for the variation, which will be referred to as "the time of variation", and this time is measured by counting the pattern read flags provided by the counter 4. Accordingly, the time of variation is given as an integer which can be selected between 1 and 16 inclusive, since sixteen read flags are produced in each bar of the rhythm as described above. In case of setting the time of variation, the accelerando or ritardando selection switch 17 o 18 is pushed first and the time parameter selection switch 14 is pushed next. Then, the preset value of this time is displayed by the display 24. Therefore, the parameter up and down switches 15 and 16 are operated as desired to adjust the displayed value to a target value. Thus, the desired time of tempo variation is set in the control unit 2. In FIG. 4, the display 24 and two shining LEDs 25 show, as an example, that the tempo is to be reduced for the time of variation corresponding to "10".

After the width and time of tempo variation are set as described above, the start/stop switch 23 is pushed to start performance of the selected rhythm pattern. If the fill-in insertion switch 22 is pushed in this state, the fill-in pattern is played in accordance with the preset width and time of variation, at a gradually rising tempo when the accelerando selection switch 17 has been pushed previously, or at a gradually slowing tempo when the ritardando selection switch 18 has been pushed previously. When neither the accelerando selection switch 17 nor the ritardando selection switch 18 has been pushed previously, the fill-in pattern is played normally.

The abovementioned process of tempo variation will be described in more detail below. In the description, it is assumed that 120 as the tempo, ROCK—10 as the rhythm pattern, ritardando as the mode of variation, 40% as the width of variation and 10 as the time of variation have been selected and preset in the control unit 2 through the switch board 5. The working memory of the control unit 2 includes seven registers denoted DTP for storing an original tempo information, STP for storing a successively varying current tempo, MC for storing a count of the master clocks corresponding to the content of STP which is derived from the counter table as shown in Table 2 which is previously stored in the ROM 3, TM for storing the time of tempo variation, TH for storing the width of tempo variation, TT for storing the width of variation per unit time of variation, namely, the width of variation divided by the time of variation, and FC for storing the number of pattern read flags produced. It will be understood that these registers store the respective preset values as shown in FIG. 5 at first in the abovementioned conditions.

If the start/stop switch 23 is pushed in this state, the control unit 2 sets the content "920" of the register MC in the counter 4 and the counter 4 starts to down-count the master clocks from this initial value and, when the count reaches zero, produces a pattern read flag. In response to the pattern read flag, the control unit 2 read out a rhythm playing pattern information of ROCK—10 from the ROM 3 and again sets the content of the register MC in the counter 4. Thereafter, the rhythm playing pattern information is successively read out in the same fashion at the original tempo of 120 and supplied to the sound source unit 1. The sound source unit 1 plays a rhythm in accordance with the supplied rhythm playing pattern information.

If the fill-in insertion switch 22 is pushed when the preset rhythm of ROCK—10 is played at the preset tempo 120, the fill-in pattern is played and its tempo is gradually reduced. This tempo reducing process will be described below with reference to the diagram of FIG. 6 which shows the tempo variation with respect to the number of read flags.

If the fill-in insertion switch 22 is pushed at a time point indicated by a numeral "1" enclosed with a small circle, the control unit 2 starts to play the fill-in pattern at the first beat of the bar of the rhythm next to the currently played bar, namely, at a time point A in the drawing. More specifically, the control unit 2 sets the content "920" of the register MC in the counter 4 and the counter 4 starts to down-count the master clocks and provides a pattern read flag when it counts out the value "920". At this time point B, the control unit 2 reads out from the ROM 3 the head rhythm pattern playing information of the fill-in pattern and raises the content of the register FC, namely, the count of the read flags, by one. At the same time, it calculates the following equation (1) and updates the content of the register STP with the result of calculation as a new tempo.

$$STP = DTP \times (1 + TT \times FC/100) \quad (1)$$

where DTP, TT and FC are the contents of the registers DTP, TT and FC, respectively. As readily understood, the value of TT × FC/100 corresponds to the percent reduction of the tempo from the original tempo DTP and the resultant value STP gives the current tempo corresponding to the flag count FC. At the time point B, STP is calculated as 115 by rounding its decimal fraction. Then, the control unit 2 confirms that the new tempo is within the abovementioned allowable range of 50 to 300 and derives the number of muster clocks corresponding to the new tempo from the counter table to update the register MC therewith. The new content of MC is set in the counter 4 and, when it is counted out at a time point C, the second read flag is produced and the next rhythm pattern playing information is read out. At this time point C, the new tempo is similarly calculated as "110" from Equation (1) and it is written in the register STP. In the same fashion, succeeding tempo value 105, 100, 96, 91, 86, 81, 76 and 72 are calculated at time points D, E, F, G, H, I, J; and K corresponding to successive counts of read flags 3, 4, 5, 6, 7, 8, 9 and 10 and a corresponding ritardando effect is exhibited as shown in the drawing.

At the time point K, the content of the register FC becomes equal to the content of the register TM and shows that the preset time of tempo variation has just lapsed. Therefore, the control unit 2 suspends the tempo variation and successively reads out the remaining fill-in rhythm playing pattern information at the preset final tempo "72" corresponding to the content "40" of the register TH. When a time point L is reached, the content of the register FC becomes "16" and the fill-in pattern has been completely read out. Then, the control, unit 2 updates the content of the register STP with the content of the register DTP, namely, the original tempo and derives a corresponding count of the master clocks from the counter table to successively read out the pattern of ROCK—10.

Figure 7:
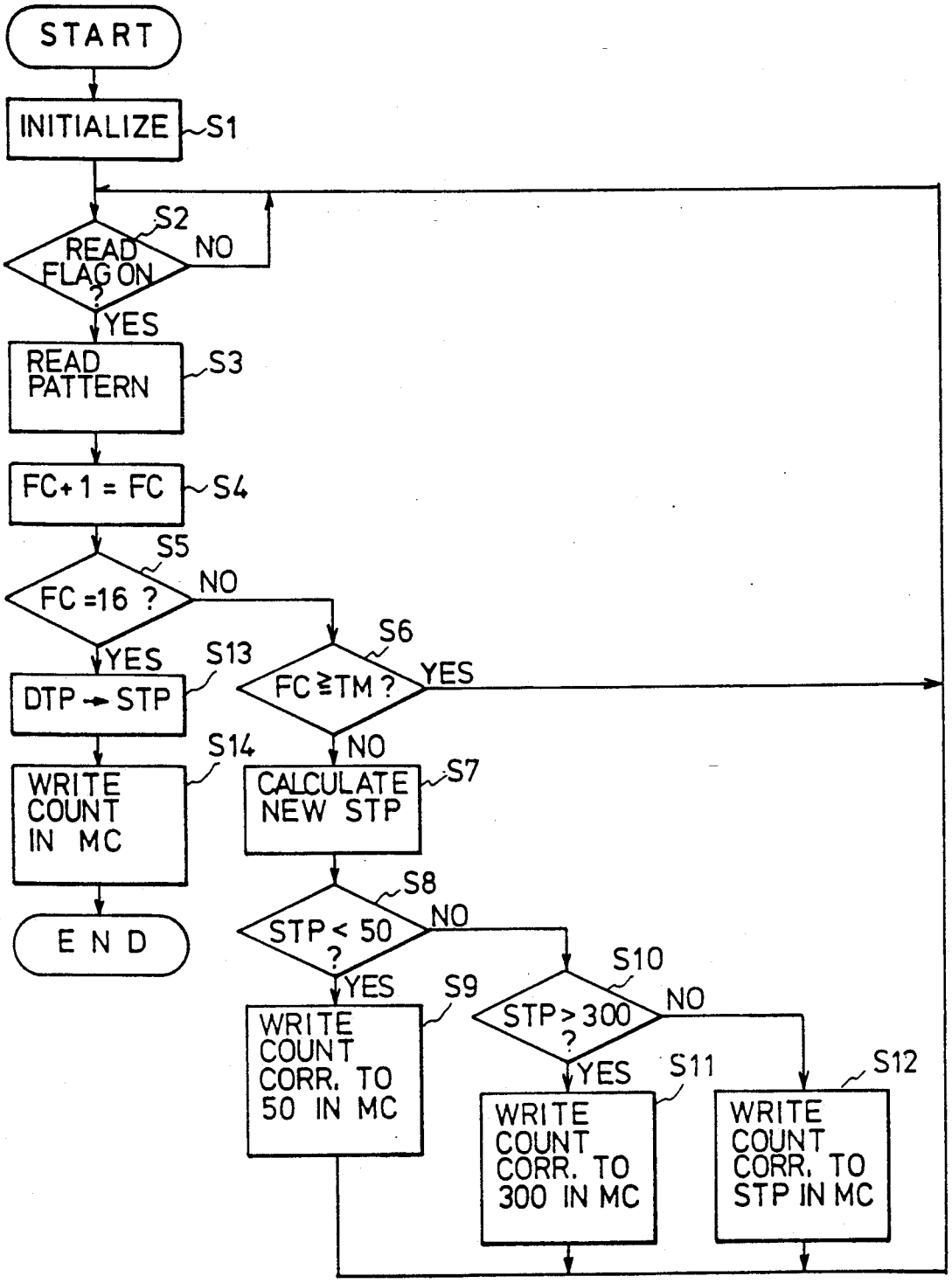
FIG. 7 is a flow chart illustrating an operation of the first embodiment.

Now, a program executed by the CPU of the control unit 2 in the abovementioned process for controlling the tempo of the fill-in pattern will be described below with reference to the flow chart as shown in FIG. 7. It is assumed that this program is inserted in a main routine, now shown, when the fill-in insertion switch 22 and the accelerando or ritardando selection switch 17 or 18 are actuated and a certain bar of the currently played rhythm is ended, and the main routine is resumed when the program is completed, and that the abovementioned values such as tempo and width and time of variation have already been set in the registers.

As shown in FIG. 7, initialization is effected first (step S1) to reset the content of the register FC to zero. Then it is inquired whether the counter 4 produces a read flag or not (step S2). If not, the step S2 is repeated until the read flag is produced and, if it is produced, a fill-in rhythm playing pattern information is read out (step S3). Next, the content of the register FC is raised by one (step S4) and it is inquired whether this content is equal to sixteen (16), the final number of flags of the fill-in pattern, or not (step S5). If not, it is inquired whether the content of FC exceeds the preset time of variation, the content of the register TM, or not (step S6). If not, a new value of tempo is sought from Equation (1) and stored in the register STP (step S7) since the tempo variation is not yet completed. Then, it is inquired whether this content of STP is less than fifty (50), the allowable lowest tempo, or not (step S8). If YES, it is impossible to play at the new tempo and, therefore, a count corresponding to the lowest tempo "50" is written in the register MC (step S9) in order to play at this tempo and the step S2 is resumed. If the new tempo is above the lowest tempo, it is further inquired whether it exceeds three hundreds (300), the allowable highest tempo, or not (step S10). If YES, it is impossible to play at this new tempo and, therefore, a count corresponding to the new tempo "300" is written in the register MC in order to play at this tempo (step S11) and the step S2 is resumed. If the new tempo is below the highest tempo "300", a count corresponding to this new tempo is written in the register MC (step S12) and the step S2 is resumed, since the new tempo is within the allowable range of "50" to "300".

If the content of FC is not less than the content of TM in step S6, the step S2 is resumed since the preset time of variation has lapsed. If the content of FC is equal to sixteen, the fill-in pattern has been completely read out. Accordingly, the register STP is updated with the content of DTP (step S13) and a count corresponding to the new content of STP is read out from the counter table and written in the register MC (step S14) to complete the program. Thus, the main routine is resumed and it becomes possible to play the original rhythm at the original tempo.

Figures 8, 9A, 9B:
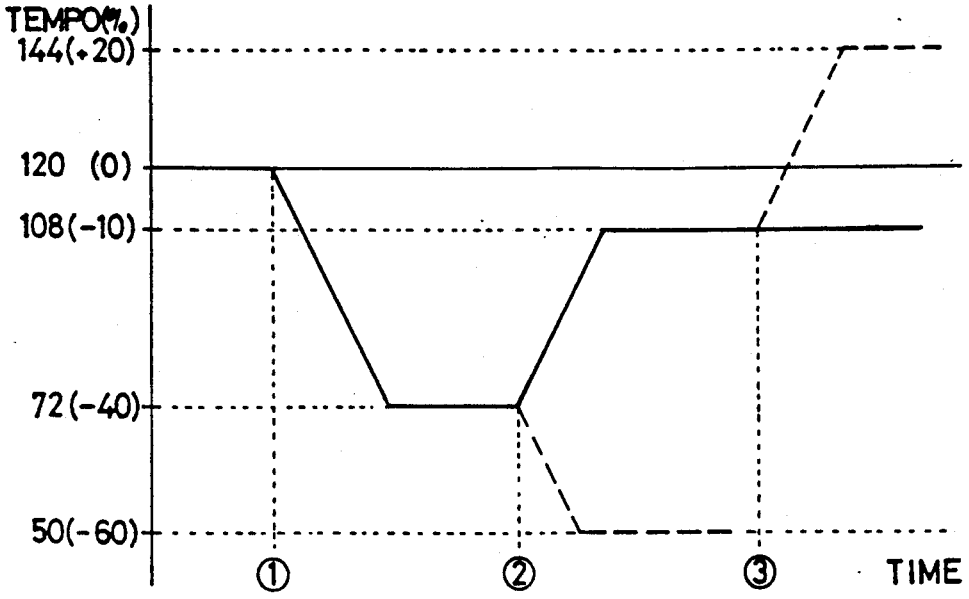
FIG. 8 is a diagram showing a tempo variation in a second embodiment of the device wherein ritardando and accelerando fill-in patterns are inserted.
FIGS. 9A and 9B are views showing two states of registers in the control unit appearing in an operation of the second embodiment.

While, in the abovementioned embodiment, the device is arranged so that any rhythm gradually reduces its tempo within predetermined part of a specific bar and recovers its original tempo at the end of the bar when a fill-in is inserted, it is also possible to arrange in accordance with this invention so that the rhythm does nor recover its original tempo at the end of the specific bar but gradually raises its tempo at a predetermined rate when another fill-in is inserted, as shown in FIG. 8 for example. In the drawing, a selected rhythm such as ROCK—10 is played first at an original tempo "120" and, in response to insertion of a fill-in accompanied by ritardando at a time point "1", reduces its tempo to a preset final value "72" as in the case of FIG. 6. In contrast to the case of FIG. 6, however, the original tempo "120" is not recovered at the end of a bar and the final tempo "72" is retained beyond the bar. If another fill-in accompanied by accelerando is inserted in the meantime at a time point "2", the tempo is gradually raised to a predetermined final level "108", for example, at a predetermined rate. If the predetermined time of variation is "10", the time rate of variation will be $(108-72)/10=3.6$ tempos per unit time of variation. The final tempo "108" is maintained as it is even if the specified fill-in pattern is completed.

For executing the abovementioned operation, the working memory of the control unit 2 includes registers denoted ATM for storing the time of variation for accelerando, ATH for storing the width of variation for accelerando, ATT for storing the width of variation per unit time of variation for accelerando, RTM for storing the time of variation for ritardando, RTH for storing the width of variation for ritardando, RTT for storing the width of variation per unit time of variation for ritardando, TTP for storing a tempo corresponding to one percent of the original tempo, and AF for storing "1" when the accelerando selection switch 17 is pushed and "0" when the ritardando selection switch 18 is pushed, in addition to those registers DTP, STP, TM, TT, MC and FC as described in the first embodiment. It is assumed that the registers ATH, ATM, ATT, RTH, RTM, RTT, DTP, STP, TTP and MC are preset to store those values as shown in FIG. 9A and the ritardando selection switch 18 is pushed to store "0" in the register AF before describing the operation with reference to the flow chart of FIG. 10.

Figure 10:
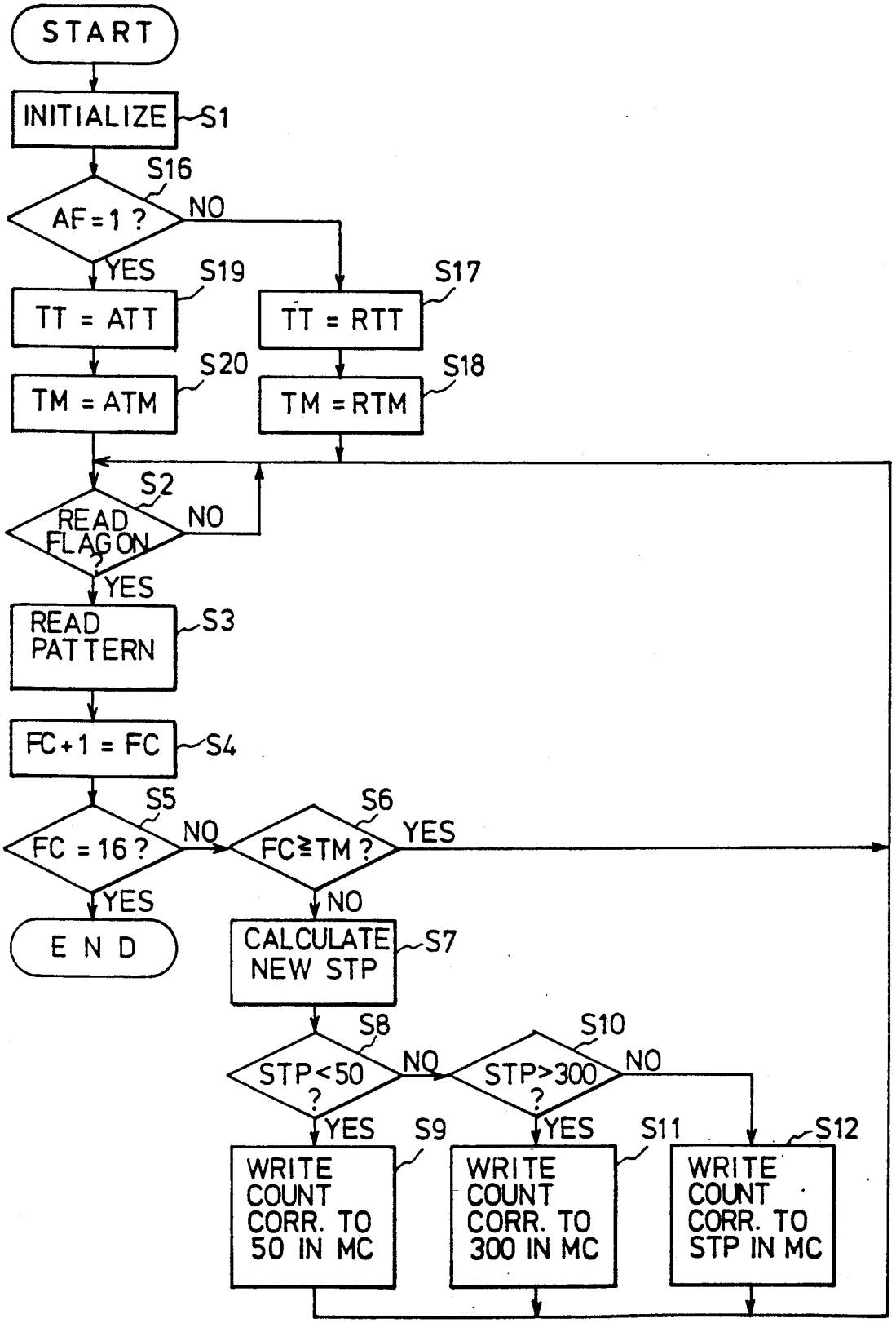
FIG. 10 is a flow chart illustrating the operation of the second embodiment.

As is understood from comparison of FIG. 10 with FIG. 7, the program of FIG. 10 is same as that of FIG. 7, except that the steps S13 and S14 are removed and new steps S16 and S20 are inserted between the steps S1 and S2. Therefore, the following description will be simplified or omitted on the common steps, as in the case of FIG. 7, the program of FIG. 10 is also inserted as an interrupt routine in the way of the main routine when the start/stop switch 23 is pushed.

Assuming now that the fill-in insertion switch 22 and the ritardando selection switch 18 are pushed and then the start/stop switch 23 is pushed at a time point "1" of FIG. 8, initialization is effected first (step S1) to reset the content of FC to zero, and it is then inquired whether the content of AF is "1" or not (step S16). As the answer is NO, the content of RTT is written in TT (step S17) and the content of RTM is written in TM (step S18). Thus, the contents of the registers are as shown in FIG. 9A at this time. Thereafter, the program is executed through steps S2 to S12 to reduce the tempo gradually to the level of "72" in the same manner as in the case of FIG. 7. In this case, however, the tempo restoring steps S13 and S14 of FIG. 7 are not executed when the end of the bar is reached in step S5. At the end of this program, the register STP stores the final tempo "72" and the register MC stores a corresponding count "1112" derived from the counter table. Accordingly, the rhythm is played at the final tempo "72" after the main routine is resumed.

If the fill-in insertion switch 22 and the accelerando selection switch 17 are pushed and then the start/stop switch 23 is pushed during execution of the main routine at a time point "2" of FIG. 8, "1" is written in the register AF and the interrupt routine of FIG. 10 is initiated. As the answer of step S16 is YES, steps S19 and S20 are executed and the contents of ATT and ATM are written in TT and TM, respectively. Thus, the content of the registers are as shown in FIG. 9B at this time. While the same steps S2 to S12 are executed thereafter, the new value of STP is calculated in step S7 by using the following equation.

$$STP=STP+(TTP + TT) \quad (2)$$

As readily understood, the product of TTP and TT corresponds to the increment of tempo per unit time of variation. Accordingly, the tempo is gradually raised from the time point "2" by the preset width of variation of 30%, namely, to the level of "108" ($=72+120\times0.3$) and maintained at this level after the end of bar is reached in step S5.

If the same ritardando fill-in pattern is played at the same time point "2", its tempo is gradually reduced as shown by a dashed line in FIG. 8 and the final level is calculated as $72-(72\times0.4)=43.2$. However, the final level is limited to "50" as shown in steps S8 and S9. If the same accelerando fill-in pattern is played at a time point "3" after the first accelerando fill-in pattern is completed, its tempo is gradually raised as shown by a dashed line and reaches the final level of "144" ($=108+36$) as shown in FIG. 8 since the allowable highest tempo is "300".

As described above, in the second embodiment of this invention, the tempo can be lowered and raised at the same or different width and time of variation which are independently selected for ritardando and accelerando, respectively. In this embodiment, moreover, the final tempo is maintained after the ritardando or accelerando fill-in pattern is ended, unless no switch is actuated further. However, this embodiment has such a disadvantage in that the original tempo can not be recovered when ritardando and accelerando fill-in patterns are played successively, unless the same width of variation is set for both ritardando and accelerando. In the third embodiment, the original tempo can be recovered even if different widths of variation have been set for ritardando and accelerando, respectively.

In the third embodiment, a normal tempo changing routine for changing the tempo of a fill-in pattern in the same fashion as in the second embodiment and an original tempo recovering routine for attaining the above-mentioned object of this embodiment are selectively used and, to this end, two registers denoted AC and RC (not shown) are additionally included in the control unit 2. These registers are adapted to store "0" or "1" in response to the following condition. Both registers AC and RC are set to "0" before the automatic accompaniment playing device is played. The register AC raises its content by one every time the accelerando variation is effected and the register RC also raises its content by one every time the ritardando variation is effected, regardless of the normal tempo changing routine and the tempo recovering routine. Both registers AC and RC reduce their contents by one every time the tempo recovering routine is ended regardless of ritardando and accelerando. In other words a rhythm is played at the original tempo when both AC and RC are "0", while it is played at a raise tempo when AC is "1" and RC is "0" and at a reduced tempo when AC is "0" and RC is "1".

Figure 11:
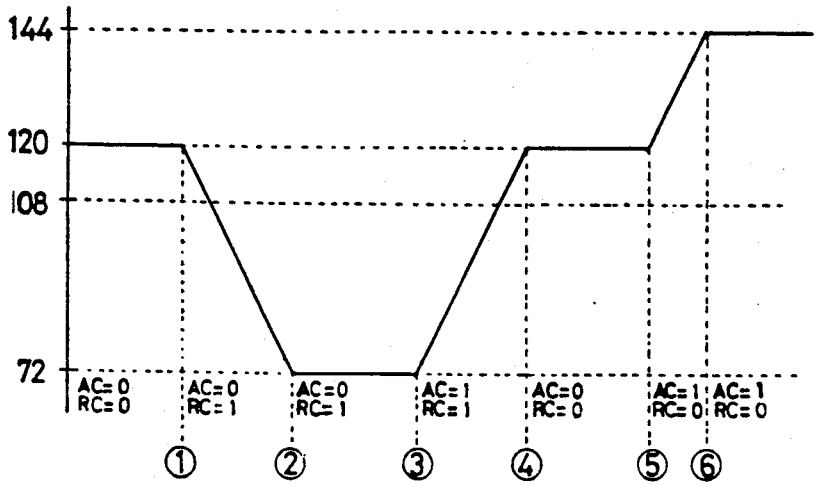
FIG. 11 is a diagram showing a tempo variation in a third embodiment in which an accelerando fill-in pattern is successively inserted twice after a length of time for which a ritardando fill-in pattern is inserted.

An example of tempo variation is shown in FIG. 11 in connection with the contents of registers AC and RC. As shown, a rhythm is played at first an original tempo "120". A ritardando variation is commenced at a time point "1" to increase RC to "1", and finished at a time point "2" to retain a reduced tempo "72". An accelerando variation is commenced at a time point "3" to increase AC to "1", and finished to recover the original tempo "120" at a time point "4" to reduce both AC and RC to "0". Another accelerando variation is commenced at a time point "5" to increase AC to "1", and finished at a time point "6" to retain the raised tempo "144". Utilizing this relation, the CPU of the control unit 2 judges whether the rhythm is played at a raised or lowered tempo in response to a ritardando or accelerando command and executes the original tempo recovering routine if the lowered tempo is played when the accelerando command is provided or if the raised tempo is played when the ritardando command is provided. A program for executing such operation will be described below with reference to the flow chart of FIG. 12.

Figure 12:
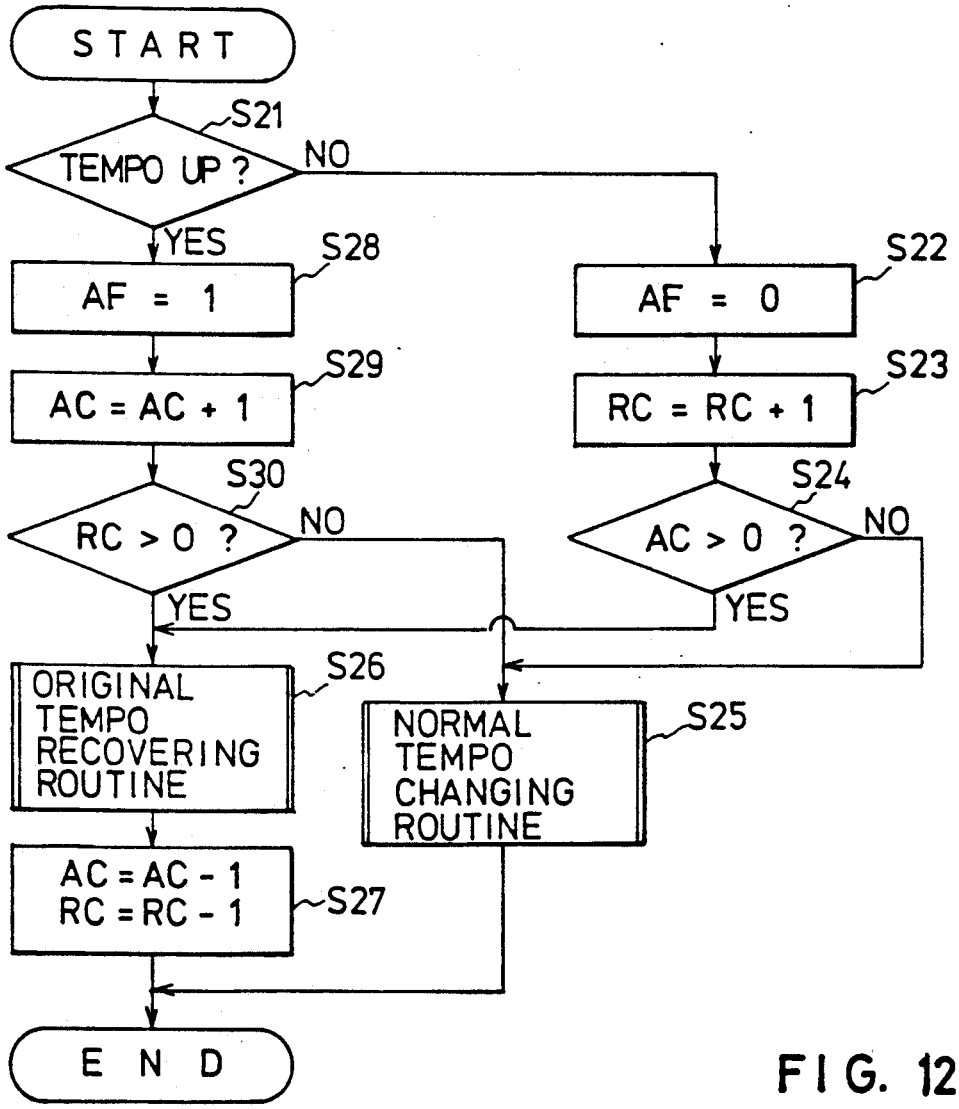
FIG. 12 is a flow chart illustrating an operation of the third embodiment.

The program of FIG. 12 is inserted as an interrupt routine in the main routine (not shown) at the end of a currently played bar of the rhythm when the accelerando or ritardando selection switch 17 or 18 and the fill-in insertion switch 22 are pushed. The registers AC and RC are automatically reset to "0" when a power is supplied to the automatic accompaniment playing device. When the program starts, it is first inquired whether the tempo is to be raised or not (step S21). This inquiry can be answered by judging whether the accelerando selection switch 17 has been pushed or not. If the answer is NO and the ritardando selection switch 18 has been pushed, the register AF is set to "0" for specifying tempo reduction (step S22) and the register RC is raised by one (step S23). Thereafter, it is inquired whether the content of AC exceeds zero or not (step S24). If not, the normal tempo changing routine is executed to reduce the tempo (step S25) since there is no need of tempo recovery. The normal tempo changing routine is given by the program as shown in FIG. 10. If the content of AC exceeds zero, the original tempo recovering routine is executed to reduce the tempo to its original level (step S26) since the tempo has been raised previously. The tempo recovering routine will be described later with reference to FIG. 13. Upon completion of the tempo recovering routine, the contents of AC and RC are reduced by one (step S27) to complete the program.

If the answer is YES in step S21 since the accelerando selection switch 17 has been pushed. The register AF is set to "1" for specifying tempo raise (step S28) and the register AC is raised by one (step S29). Thereafter, it is inquired whether the content of RC exceeds zero or not (step S30). If not, the normal tempo changing routine is executed to raise the tempo (step S25) since there is no need of tempo recovery. If the content of RC exceeds zero, the tempo recovering routine is executed to raise the tempo to its original level (step S26) since the tempo has been reduced previously.

Figure 13:
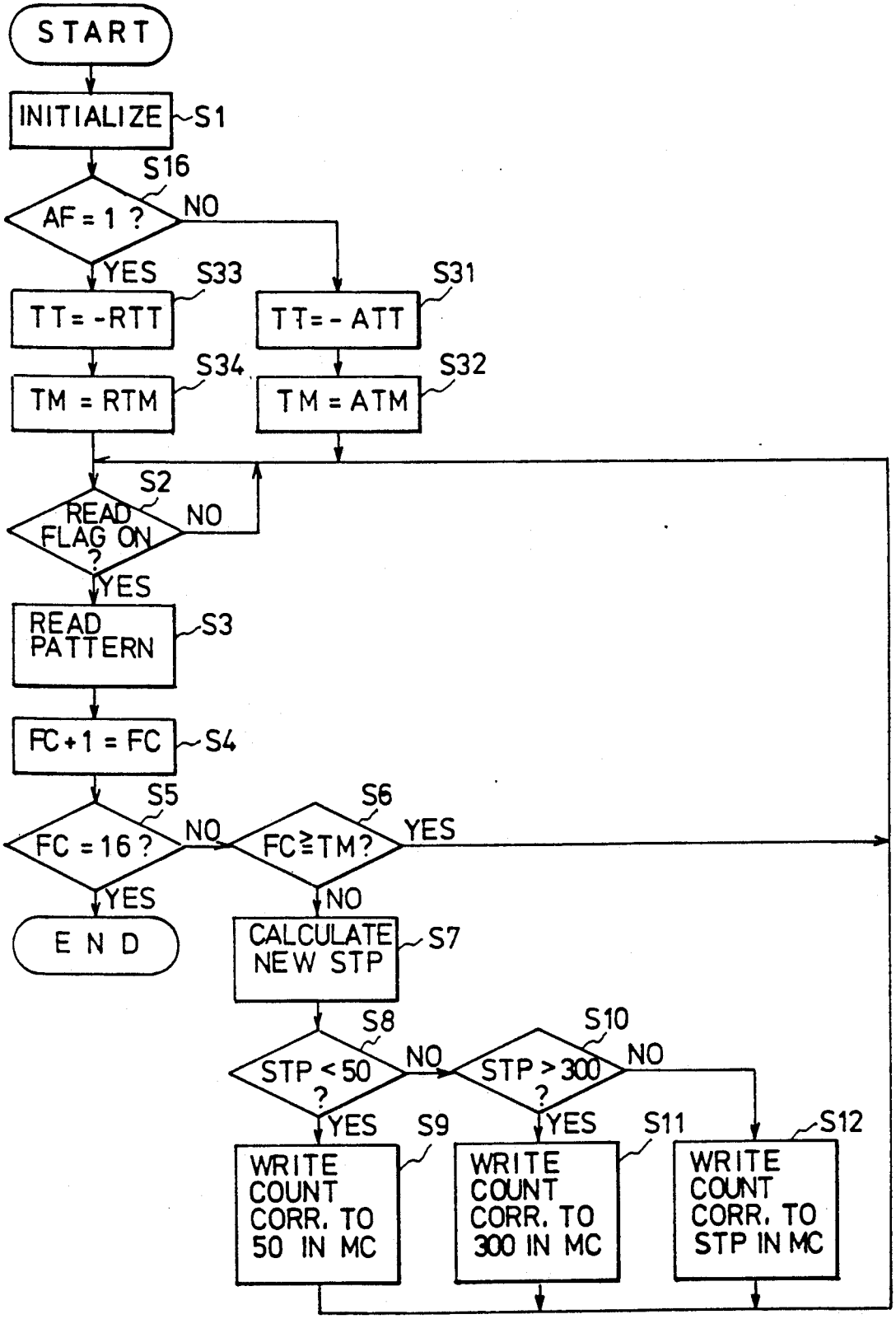
FIG. 13 is a detailed flow chart showing the original tempo recovering routine in the flow chart of FIG. 12.

The flow chart of FIG. 13 gives a program of the abovementioned original tempo recovering routine. This program is exactly same as the program of normal tempo changing routine as shown in FIG. 10, except that steps S31 to S34 are substituted for the steps S17 to S20, respectively. As shown, in this program, the content of ATT having its sign inverted is written in the register TT (step S31) and the content of ATM is written in the register TM (step S32) when the tempo is reduced to the original level and the answer in step S16 is NO, while the content of RTT having its sign inverted is written in the register TT (step S33) and the content of RTM is written in the register TM (step S34) when the tempo is to be raised to the original tempo and the answer in step S16 is YES. Accordingly, if the tempo has been reduced previously by a certain width, it is raised by the same width to recover its original level, and vice versa. In the original tempo recovering program of FIG. 13, the steps S8 to S11 may be omitted since the tempo should not come out of the allowable range of "50" to "300".

While the tempo of the fill-in pattern is changed in the above embodiments, the tempo of the introduction or ending pattern may be changed. Not only the tempo of such inserted rhythm patterns, but also the tempo of the basic normal pattern may be changed if desired. Instead of the switch board 5, other equipments such as sequencer may be used for instructing insertion of the fill-in pattern.

While the information regarding the magnitude and direction of the tempo variation, namely, the width of variation, is specified as a percent change of the tempo with respect to the original tempo in the above embodiments, it may be specified as an actual value of the tempo variation, which will be referred to as "$X_1$". In order to store this value $X_1$, a register X may be provided in the first embodiment, instead of the registers TH and TT, and the value of STP may be calculated by the following equation in step S7, instead of Equation (1).

$$STP=DTP \times(1+X_1\times FC/TM) \quad (3)$$

In the second and third embodiments, the registers ATH, ATT, RTH, RTT, and TT may be removed and, instead, new registers AX and RX may be provided for storing the value $X_1$ for accelerando and ritardando, respectively. The register X may be adapted to store the value $X_1$ for accelerando or ritardando in accordance with the aforementioned value of AF and the value of STP may be calculated by the following equation instead of Equation (2).

$$STP=STP+X_1\times FC/TM \quad (4)$$

An actual value of the final tempo, which will be referred to as "$X_2$", may be given for specifying the width of variation. In this case, this value $X_2$ may be stored in the abovementioned register X in the first embodiment and the value of STP may be calculated by the following equation instead of Equation (1).

$$STP=DTP \times[1+(X_2-DTP)\times FC/TM] \quad (5)$$

In the second and third embodiments, the value $X_2$ may be stored in the registers AX and RX and the value of STP may be calculated by the following equation instead of Equation (2).

$$STP=STP+(X_2-DTP)\times FC/TM \quad (6)$$

A percentage of the final tempo with respect to the original tempo, which will be referred to as "$X_3$", may be given for specifying the width of variation. In this case, the value $X_3$ may be stored in the register X in the first embodiment and the value of STP may be calculated by the following equation instead of Equation (1).

$$STP=DTP\times[1+(X_3-100)\times FC/TM/100] \quad (7)$$

In the second and third embodiments, the value $X_3$ may be stored in the registers AX and RX and the value of STP may be calculated by the following equation instead of Equation (2).

$$STP=STP+DTP \times (X_3-100)\times FC/TM/100 \quad (8)$$

A value of tempo variation per unit time or flag, which will be referred to as "$X_4$", may be given for specifying the width of variation. In this case, the value $X_4$ may be stored of register X in the first embodiment and the value of STP may be calculated by the following equation.

$$STP=DTP+X_4\times FC \quad (9)$$

In the second and third embodiments, the value $X_4$ may be stored in the registers AX and RX and the value of STP may be calculated by the following equation.

$$STP=STP+X_4\times FC \quad (10)$$

A percent change of the tempo per unit time or flag with respect to the original tempo, which will be referred to as "$X_5$", may be given for specifying the width of variation. In this case, the value $X_5$ may be stored in the register X in the first embodiment and the value of STP may be calculated by the following equation.

$$STP=DTP \times(1+X_5\times FC/100) \quad (11)$$

In the second and third embodiments, the value $X_5$ may be stored in the registers AX and RX and the value of STP may be calculated by the following equation.

$$STP=STP \times(1+X_5FC/100) \quad (12)$$

What is claimed is:

1. An automatic accompaniment musical apparatus comprising storing means for storing various normal rhythm patterns, means for selecting any one of said normal rhythm patterns from said storing means to play the patterns at a predetermined tempo, first programming means for setting and generating a first information signal regarding the magnitude of gradual tempo variation of said predetermined tempo, second programming means for setting and generating a second information signal regarding the time duration of said gradual tempo variation and control means for automatically changing the tempo of said rhythm patterns based upon said first and second information signals provided by said first and second programming means.

2. A device as set forth in claim 1, wherein said first information signal is the magnitude of said tempo gradual variation.

3. A device as set forth in claim 1, wherein said first information signal is a rate of the magnitude of said gradual tempo variation with respect to said predetermined tempo.

4. A device as set forth in claim 1, wherein said first information signal is the magnitude of said gradual tempo variation per unit time of said rhythm patterns.

5. A device as set forth in claim 4, wherein said unit time is a submultiple of a quarter note duration.

6. A device as set forth in claim 1, wherein said first information signal is a rate of the magnitude of said gradual tempo variation per unit time with respect to said predetermined tempo.

7. A device as set forth in claim 6, wherein said unit time is a submultiple of a quarter note duration.

8. A device as set forth in claim 1, wherein said first information signal is a final tempo upon completion of said gradual tempo variation.

9. A device as set forth in claim 1, wherein said first information signal is a rate of a final tempo upon completion of said gradual tempo variation with respect to said predetermined tempo.

10. A device as set forth in claim 1, wherein said second information signal is the number of beats spent for said gradual tempo variation.

11. A device as set forth in claim 1, wherein said control means includes means for selectively setting said first information signal in a direction of gradually accelerating said tempo and another direction of gradually decelerating said tempo.

12. A device as set forth in claim 11, wherein said control means includes means for recovering said predetermined tempo, when said tempo is changed in a first direction and, thereafter, in a second direction opposite to said first direction, regardless of said first information signal preset for said second direction.

13. A device as set forth in claim 1, wherein said device further comprises means for inserting in said normal rhythm pattern a different temporary rhythm pattern in the middle of performance of said normal rhythm pattern, and said control means includes means for gradually changing the tempo of said temporary rhythm pattern based upon said first and second information signal.

14. A device as set forth in claim 13, wherein said control means includes means for retaining the final tempo after completion of said tempo variation until the end of said temporary rhythm pattern, and means for restoring said final tempo to said predetermined tempo upon completion of said temporary rhythm pattern.

15. A device as set forth in claim 13, wherein said control means includes means for retaining said final gradual tempo upon completion of said tempo variation still after the end of said temporary rhythm pattern.

* * * * *